United States Patent [19]

Reimert

[11] Patent Number: 4,941,691

[45] Date of Patent: Jul. 17, 1990

[54] SUBSEA WELLHEAD EQUIPMENT

[75] Inventor: Larry E. Reimert, Houston, Tex.

[73] Assignee: Dril-Quip, Inc., Houston, Tex.

[21] Appl. No.: 204,089

[22] Filed: Jun. 8, 1988

[51] Int. Cl.[5] ..... F16L 35/00

[52] U.S. Cl. ..... 285/39; 285/315

[58] Field of Search ..... 285/18, 39, 314, 315, 285/321

[56] References Cited

U.S. PATENT DOCUMENTS

| | | | |
|---|---|---|---|
| 1,769,381 | 7/1930 | Montgomery | 285/18 |
| 4,222,590 | 9/1980 | Regan | 285/321 |
| 4,343,495 | 8/1982 | Nobileau et al. . | |
| 4,416,472 | 11/1983 | Fowler et al. | 285/39 |
| 4,456,070 | 6/1984 | Watkins . | |
| 4,465,134 | 8/1984 | Watkins . | |
| 4,607,865 | 8/1986 | Hughes . | |
| 4,609,046 | 9/1986 | Schawann et al. . | |
| 4,610,465 | 9/1986 | Boyadjieff | 285/18 |
| 4,611,829 | 9/1986 | Hughes . | |
| 4,613,162 | 9/1986 | Hughes . | |
| 4,613,164 | 9/1986 | Hughes et al. . | |
| 4,635,728 | 1/1987 | Harrington . | |
| 4,651,830 | 3/1987 | Crotwell | 285/18 |
| 4,681,166 | 7/1987 | Cuiper . | |
| 4,696,493 | 9/1987 | Brammer . | |
| 4,699,215 | 10/1987 | Cuiper . | |
| 4,872,708 | 10/1989 | Abreo | 285/34 |

*Primary Examiner*—Dave W. Arola

*Attorney, Agent, or Firm*—Vaden, Eickenroht, Thompson & Boulware

[57] ABSTRACT

A tieback connector for use in connecting the lower end of a well conductor to the upper end of a tubular wellhead member by a radially movable split locking ring carried by the tieback connector for locking engagement within grooves formed in the bore of the wellhead member.

9 Claims, 3 Drawing Sheets

SUBSEA WELLHEAD EQUIPMENT

This invention relates generally to subsea wellhead equipment, and, more particularly, to an improved tieback connector for connecting a conductor to an upright, tubular member of the wellhead for extension upwardly to a fixed platform above the subsea level.

Tie back connectors of this general type are required when the well is drilled from a floating drilling rig for later production from a fixed platform. In these cases, the conductor or conductors are lowered from the platform for connection to the wellhead member, which may be a casing head or a casing hanger suspended within the head. Following connection of the conductor and casing, production tubing is lowered through the innermost casing, and a production tree is installed in a conventional manner.

Some prior tieback connectors require threads or other special preparations on the bore of the wellhead member which are difficult to make up at the substantial depths involved. Other tieback connectors, such as that shown in U.S. Pat. No. 4,696,493, have locking means which is radially expandable into grooves about the bore. However, neither they nor other tieback connectors of which I am aware provide a secure connection notwithstanding the loads which are imposed in such an environment and resulting fatigue which may occur in the connection.

The object of this invention is to provide a tieback connector of this general type which has a radially expandable locking means for connecting with one or more grooves about the bore of the wellhead member and which provides a secure connection capable of withstanding such loading.

Another object is to provide a tieback connector which is of compact construction and relatively easy to assemble and disassemble.

These and other objects are accomplished, in accordance with the illustrated and preferred embodiment of the invention, by a tieback connector of the type described which comprises body means lowerable with the conductor and having a lower end which fits within the bore of the wellhead member as it is so lowered, downwardly facing shoulder means for landing on upwardly facing seat means on the wellhead member about the upper end of its bore, and locking means which is carried about the body means for disposal opposite the groove, when the shoulder means lands on the seat means, and radial movement with respect to the body means between an inner position to permit the locking means to move into and an outer position within the groove. More particularly, the locking means has conically tapered surfaces on its inner side and inwardly and outwardly conically tapered surfaces on its outer side to conform with the conically tapered upper end of the groove, and wedge means mounted for vertical movement with respect to the body means has conical surfaces on its outer side which are complimentary and slidable over the inner surfaces of the locking means and surfaces on its inner side for sliding over inner surfaces of the body means generally opposite the locking means, as the wedge means moves in one vertical direction with respect to the body means, so as to wedge the locking means into the groove and the conically tapered surfaces thereon against the conically tapered surfaces on the upper end of the groove, whereby continued lowering of the wedge means causes the upper end of the wellhead member to be tightly gripped between the locking means and the shoulder means of the body member so as to preload the connection to the extent necessary to withstand anticipated loadings. Thus, a nut is threadedly connected to the wedge means and mounted on the body means for rotation with respect thereto, while being held against vertical movement in the opposite direction, and means are provided on the nut for engagement by means on a tool lowered through the conductor for rotating the nut in order to move the wedge means in said vertical direction.

In the preferred and illustrated embodiment of the invention, the locking means is a split ring which is inherently contractable toward its inner position. Also, the nut is threadedly engaged with the upper end of the wedge means, and the wedging surfaces on the wedge means are on its inner end for moving downwardly into wedging position between the surfaces of the body and the locking means, thereby providing a compact construction.

In its preferred form, the body means includes an outer tubular body member which is connectable to the conductor for lowering therewith and on which the shoulder means is formed, an inner tubular body member threadedly connected to the outer body member and having the lower end which is fittable within the bore of the wellhead member and on which the lock means is carried, and means releasably connecting the inner and outer tubular body members to prevent relative rotation between them. The nut is releasably held against upward movement with respect to the inner body and supported for rotation with respect to the inner body in a position spaced inwardly of the outer body member, and the wedge means includes a ring at its upper end which is threadedly connected to the nut between the nut and the outer body member. More particularly, the outer body member has vertical slots therein which are opposite its threaded connection to the inner body member, and the wedge means also include fingers which depend from the wedge ring for extension through the slots and which have the conical surfaces on their outer sides which are complimentary to the inner conical surface of the locking ring and surfaces on their inner sides for sliding over an inner surface of the inner body member between its threaded connection to the outer body member and generally opposite the locking means.

The connector may be assembled by mounting the lock ring on a shoulder about the inner body member, threadedly connecting the inner and outer body members to one another, connecting the wedge ring to the nut and lowering of the wedge fingers into the slots, releasably mounting a stop ring on the inner side of the outer body member above the nut and wedge ring, and finally extending pins through holes in the outer body member and into the inner body member to prevent rotation between them.

In the drawings, wherein like reference characters are used through out to indicate like parts:

FIG. 1 is a vertical sectional view of the tieback connector, as seen along broken lines 1—1 of FIG. 3, with the wedge means shown partly in elevation, and upon lowering of the lower end of the inner body member into the bore of the wellhead member and the shoulder means on the outer body member into landed position of the seat means on the wellhead member to dispose the locking means opposite the grooves in the bore of the wellhead member;

Figure 1:
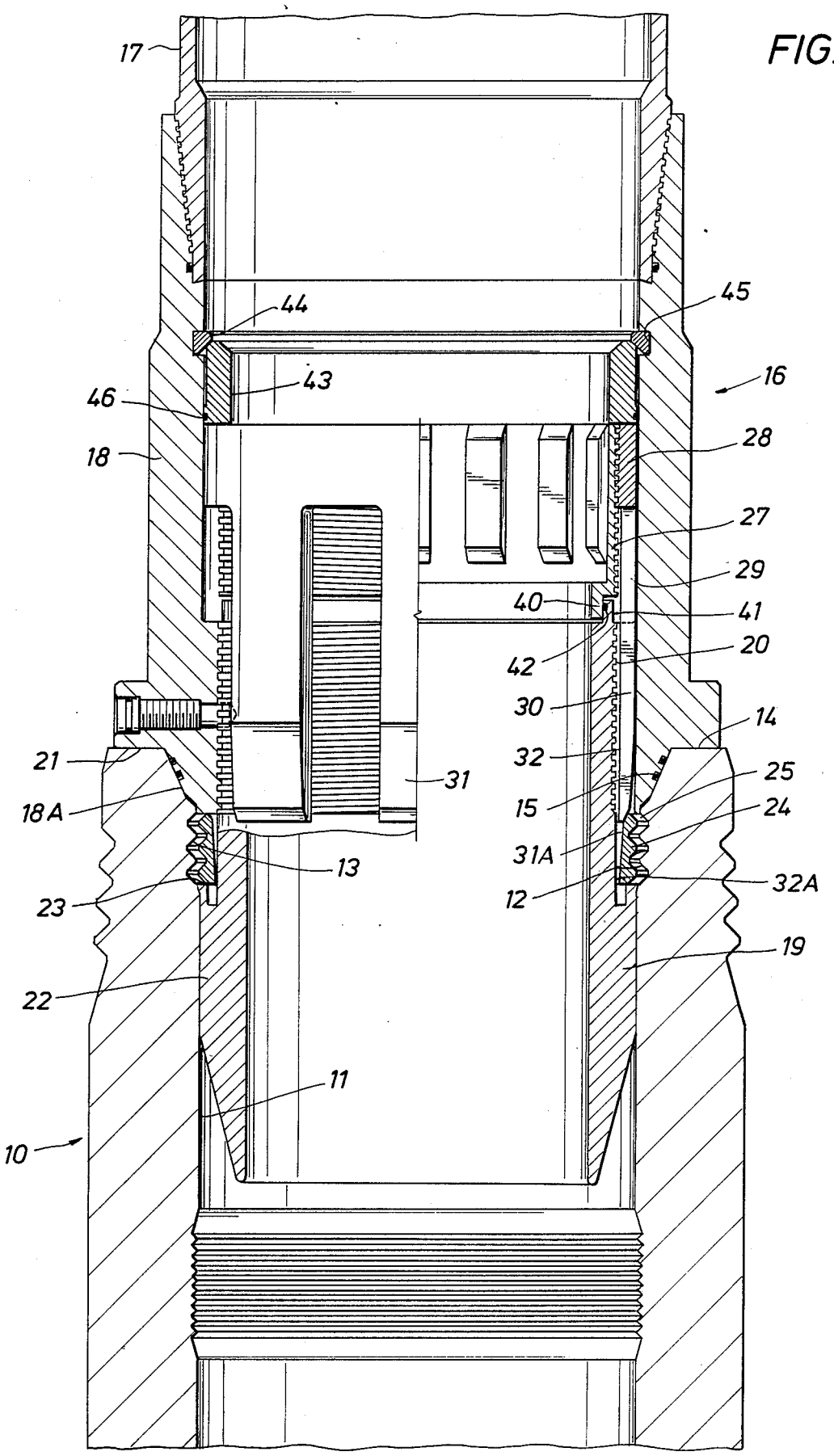

Referring now to the details of the above described drawings, the subsea wellhead is shown to include a casing head 10 mounted in an upright position at the subsea level and having a bore 11 therethrough adapted to receive and support one or more casing hangers (not shown) from which well casings are suspended. Insofar as the present invention is concerned, it is merely necessary to note that grooves 12 are formed in the bore near the upper end of the casing head, with each such groove having an upper end 13 which is tapered downwardly and outwardly with respect to the bore, and further that the upper end of the casing head has upwardly facing seat means 14 on which the tieback member to be described may be supported, including an outer surface 14 and a downwardly and inwardly, conically shaped seal surface 15 within the outer surface to receive a similarly shaped seal surface of the tieback connector.

The tieback connector, which is indicated in its entirety by reference character 16, is adapted to be lowered with a conductor 17 for connection to the casing head and extension upwardly to a fixed platform at the surface level from which the well may be produced. As shown, the tieback connector includes body means comprised of an outer tubular body member 18 whose upper end is threadedly connected to the lower end of the conductor 17, an inner tubular body member 19 which is connected to the outer body member by means of square threads 20, and pins 35 which extent through the outer body and into the inner body to prevent their disconnection.

Figure 2:
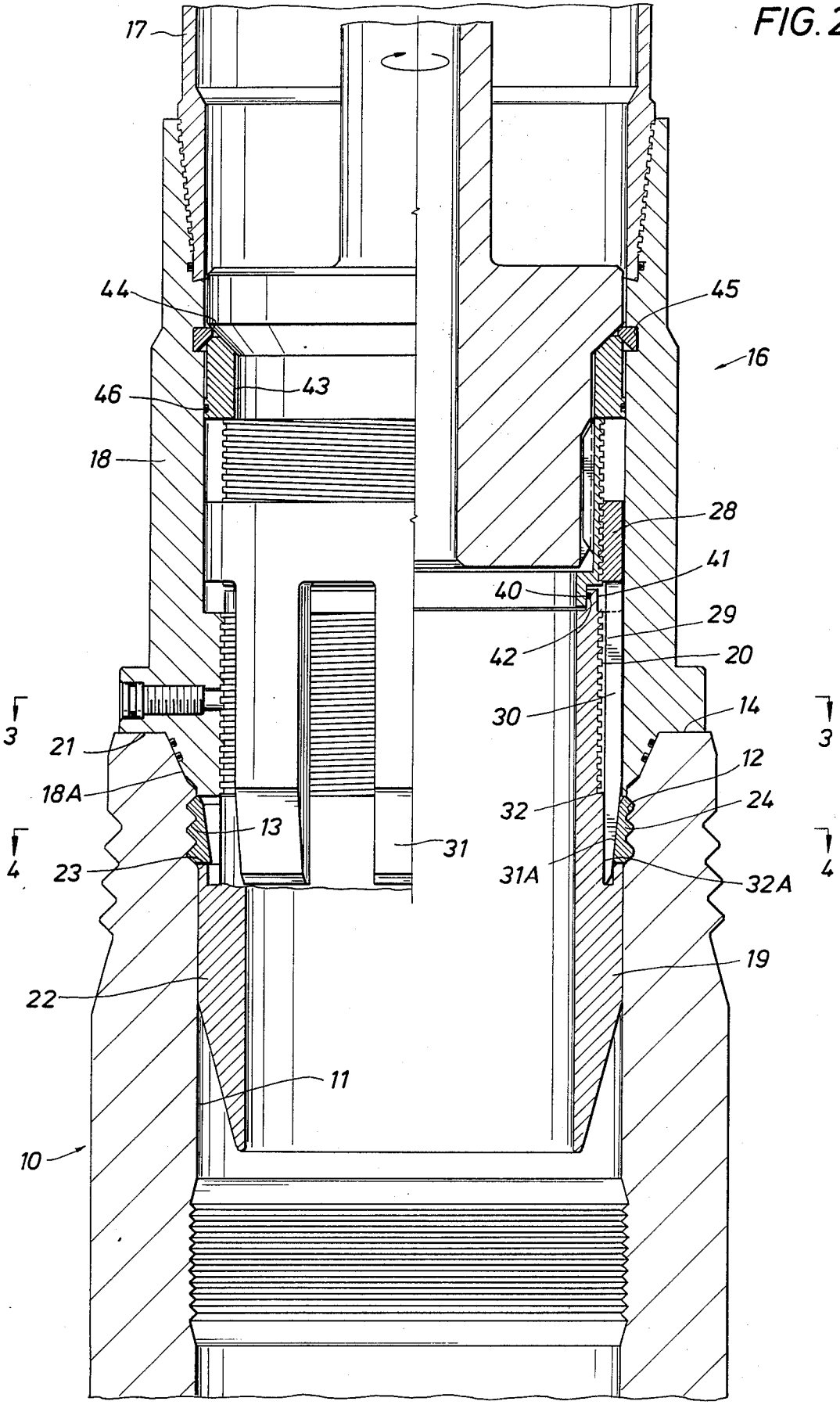
FIG. 2 is a view similar to FIG. 1, but upon lowering of a torque tool into rotatable engagement with the nut of the tieback member and rotation of the tool to rotate the nut and thus lower the wedge means to wedge the locking ring tightly into the grooves of the wellhead member.
Figure 3:
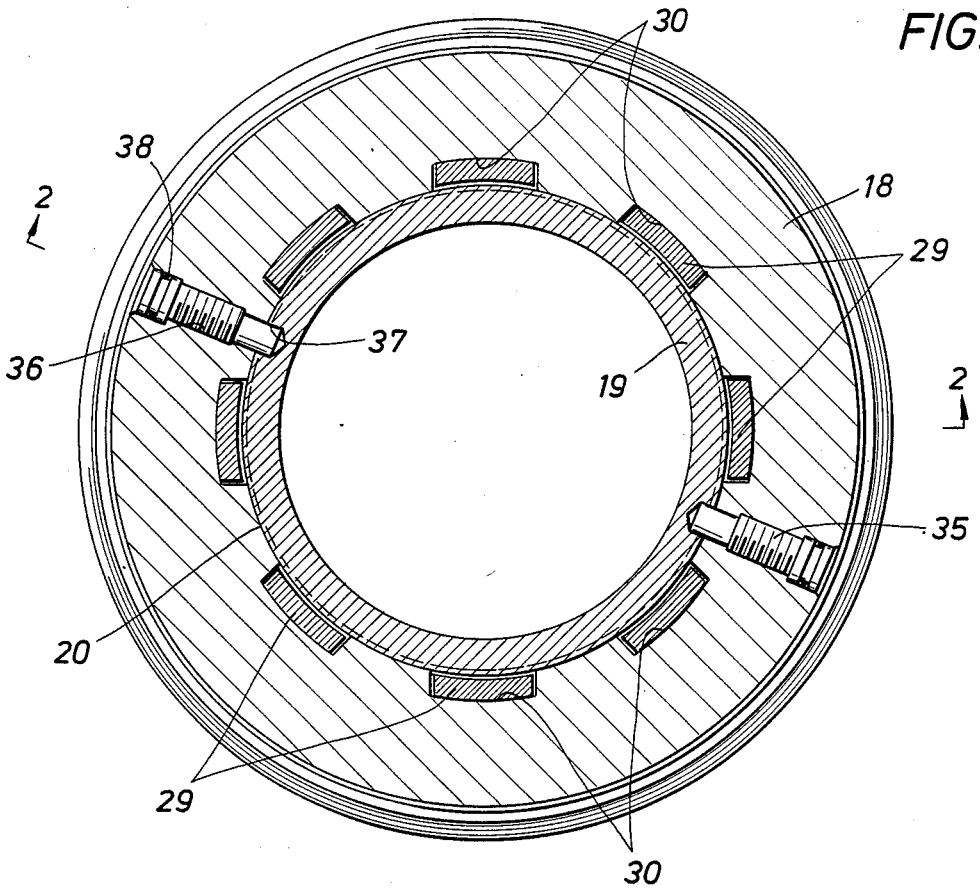
FIG. 3 is a cross-sectional view of the tieback connector, as seen along broken lines 3—3 of FIG. 2.
Figure 4:
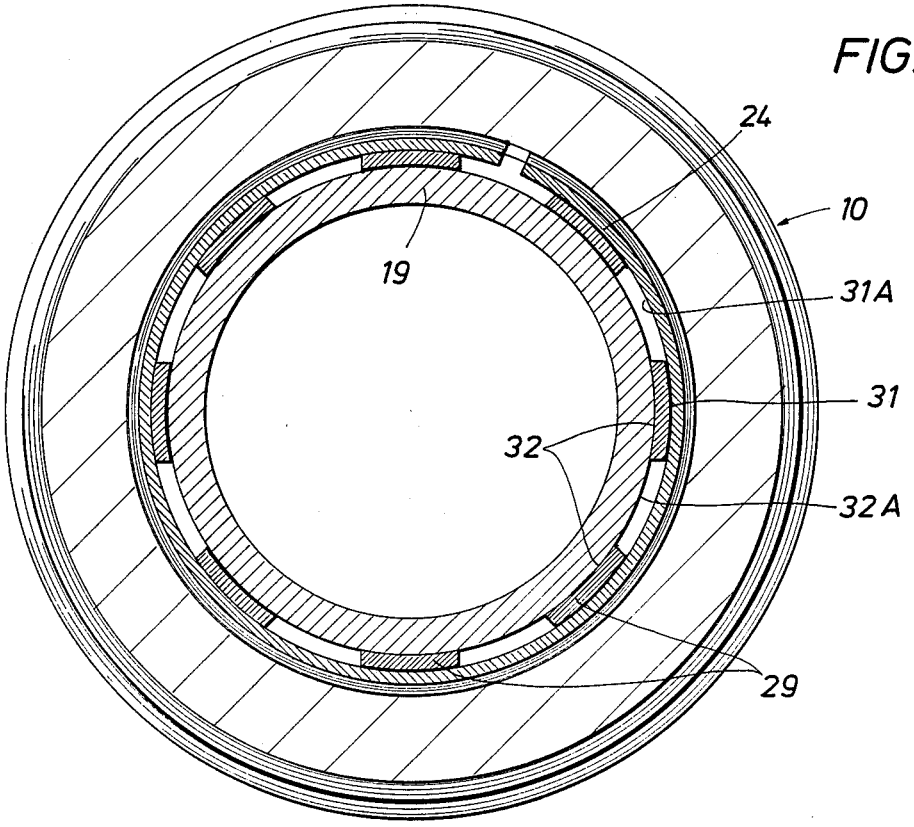
FIG. 4 is a cross-sectional view of the wellhead member and tieback connector, as seen along broken lines 4—4 of FIG. 2.

The outer body member has a flange near its lower end whose lower side provides downwardly facing shoulder means adapted to be supported on the seat means of the casing head as the tieback connector is lowered onto the casing head to the position shown in FIGS. 1 and 2, including an outer surface 21 adapted to be supported on the outer surface 14 of the seat means and a lower extension 18A beneath the flange and within the outer surface having a downwardly and inwardly tapered conical seal surface conforming to the seal surface 15 on the casing head and seal rings carried about the surface for sealably engaging with the seal surface of the head as the connector is landed. The inner body member 19, on the other hand, has a lower end 22 which fits closely within the bore 11 of the casing head as the outer body member is lowered into landed position on the casing head, and an annular shoulder 23 formed thereabout beneath the lower end of extension 18A.

The apparatus is preferably so designed that the outer surfaces engage prior to the seal surfaces. It is possible, however, that the seal surfaces will first engage, and the use of the terms "seat means" and "shoulder means" anticipates that either may engage before the other.

As shown, locking means in the form of a split ring 24 is carried about the inner body above the shoulder 23 so as to be disposed opposite the groove as the lower end of the inner body moves downwardly into the bore of the casing head. Thus, as shown, the lock ring has three teeth formed thereabout each for disposal opposite one of the grooves, with each such tooth having an upper surface 25 which is conically tapered outwardly and downwardly to conform with the conically shaped upper end 13 of its opposite groove. The split ring is normally contracted inwardly to its inner position so that its outer side is substantially in alignment with the outer diameter of the lower end 19 of the inner body member to permit the lock ring to be lowered easily into the position of FIGS. 1 and 2.

As previously described, the tieback connector also includes a nut 27 which is carried by the body means for rotation with respect to it while being held against upward movement, and wedge means threadedly connected to the nut for vertical downward movement with respect thereto into a position to wedge the locking means tightly into the grooves. More particularly, the wedge means includes a ring 28 at its upper end which is threadedly connected to the nut within a space between the nut and the inner diameter of the outer body member, and fingers 29 which depend from the ring for extension through slots 30 formed in the inner diameter of the outer body member opposite the threads which connect the inner and outer body members. The lower ends of the fingers have inwardly and downwardly conically shaped surfaces 31 which are disposed above the lock ring 24 when the wedge ring is in its upper position, as shown in FIG. 1, but which move downwardly between a complimentary, inwardly and downwardly conical surface 31A on the inner side of the lock ring 24 and inner surfaces 32 which are cylindrically shaped for fitting tightly within the cylindrically shaped surface 32A of the inner body member opposite the lock ring 24 and above the shoulder 23 on which the lock ring is supported.

Hence, upon rotation of the nut to lower the wedge ring from the position of FIG. 1 to the position of FIG. 2, the fingers are moved downwardly within the lock ring to wedge the lock ring outwardly into the grooves in the bore of the casing head. More particularly, due to the tapered wedging surfaces between the fingers and the inner side of the lock ring, as well as the outwardly and downwardly tapered surfaces of the upper ends of the locking grooves, the upper end of the wellhead member is squeezed between the surfaces 13 and the shoulder 21 so as to preload the connection between the tieback connector and the casing head.

The pins 35 extend through holes 36 in the outer body member and into holes 37 in the outer diameter of the inner body member so as to prevent relative rotation between the inner and outer body members as the nut is rotated to move the wedge ring and fingers downwardly through the slots in the outer body member. As shown, the pins are threaded to connect with the holes 36 and carry seal rings 38 to sealably engage the outer ends of the holes when moved into the holes 37.

The lower end of the nut 27 has a downwardly extending flange 40 which fits closely within an upstanding flange 41 on the upper end of the inner body member so as to hold the nut in a concentric position with respect to the inner body member, and a seal ring 42 is carried by the flange 41 to provide a sliding seal with respect to the flange 40. The nut is held down against upward movement by means of a stop ring 43 which rests on the upper end of the nut and above the wedge ring and is releasably held against upward movement by means of a split ring 44 releasably received within a groove 45 in the bore of the outer body member. A seal ring 46 is carried on the outer diameter of the ring 43 to form a sliding seal between it and the bore of the outer body member.

Prior to being lowered into connection with the casing head, the tieback connector is assembled by first lowering the split ring 24 over the threaded upper end of the inner body member to support it on the shoulder 23, and the inner and outer bodies are threadedly connected, but with the inner body initially in a somewhat lower position than that shown. At this time, the nut and wedge ring may be threadedly connected to one another to dispose them in the position of FIG. 1, and the fingers of the wedge means moved downwardly through the slots formed in the outer body member to lower the flange on the lower end of the nut about the flange on the upper end of the inner body. The stop ring 43 is then lowered onto the nut, and the split ring 44 is moved into the groove 45 above the ring 43, following which the inner body member may be rotated to move it upwardly with respect to the outer body member in order to lift the nut and thus the ring 43 upwardly into engagement with the split ring 44. The pins 35 may then be installed to complete the assembly.

From the foregoing it will be seen that this invention is one well adapted to attain all of the ends and objects hereinabove set forth, together with other advantages which are obvious and which are inherent to the apparatus It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. For use in connecting a conductor to a tubular wellhead member mounted in an upright position at a subsea location and having a groove about its bore whose upper end is conically tapered downwardly and outwardly with respect to the bore and upwardly facing seat means about the upper end of the bore, a tieback connector comprising body means lowerable with the conductor and having a lower end which fits within the bore of the wellhead member, as the body means is so lowered, and downwardly facing shoulder means thereon adapted to be supported on the seat means to prevent further downward movement of the body means, locking means carried about the body means for disposal opposite the groove, when the shoulder lands on the seat, and being radially movable with respect thereto between an inner position to permit the locking means to move into the bore and an outer position within the groove, said locking means having conically tapered surfaces on its inner side and downwardly and outwardly conically tapered surfaces on its outer side to conform with the conically tapered upper end of the groove, wedge means connected to the body means for vertical movement without rotation with respect to the body means and having conical surfaces on its outer side which are complimentary to and slidable over the inner conical surfaces of the locking means and surfaces on its inner side for sliding over an inner surface of the body means generally opposite the locking means, as the wedge body moves in one vertical direction with respect to the body means, so as to wedge the locking means into the groove and the conically tapered surface thereon tightly against the conically tapered surface of the upper end of the groove, and a nut threadedly connected to the wedge means and mounted on the body means for rotation with respect thereto while being held against vertical movement in said opposite vertical direction, said nut having means thereon engagable by means on a tool lowered through the conductor for rotating the nut in order to move said wedge means in said one vertical direction.

2. A tieback connector of the character defined in claim 1, wherein the locking means is a split ring which in inherently contractable toward its inner position.

3. A tieback connector of the character defined in claim 1, wherein seat means of the wellhead member includes an outer surface and a seal surface within the outer surface and above the groove, and the shoulder means of the body means has an outer surface adapted to be supported on the outer surface and a lower extension within the outer surface and a complementary seal surface on the extension for disposal within the seal surface of the wellhead member, and seal means are carried by the seal surface of the body means extension to sealably engage the seal surface of the wellhead member.

4. A tieback connector of the character defined in claim 1, wherein the nut is threadably engaged with the upper end of the wedge means, and the surfaces of the wedge means are on its lower end for moving downwardly into wedging position between the surfaces of the body means and locking means.

5. For use in connecting a conductor to a tubular wellhead member mounted in an upright position at a subsea location and having a groove about its bore whose upper end is conically tapered downwardly and outwardly with respect to the bore and upwardly facing seat means about the upper end of the bore, a tieback connector comprising body means including an outer tubular body member connectable to the conductor for lowering therewith and having downwardly facing shoulder means adapted to be supported on the seat means as it is so lowered, an inner tubular body member threadedly connected to the outer body member and having a lower end fittable within the bore of the wellhead member as it is lowered with the outer body member, and means connecting the inner and outer tubular body members to prevent relative rotation between them, locking means carried about the inner body member and beneath its threaded connection to the outer tubular member for disposal opposite the groove when the shoulder lands on the seat, said locking means having conically tapered surfaces on its inner side and downwardly and outwardly conically tapered surfaces on its outer side to conform with the conically tapered upper end of the groove, one of said tubular body members having vertical slots therein opposite its threaded connection to the inner tubular body member, wedge means connected to the body means for vertical movement without rotation with respect to the body means and fingers depending from the ring for extention through the slots, the lower ends of the fingers having conical surfaces on their outer sides which are complimentary to and slidable over the inner conical surfaces of the locking means and surfaces on their inner side for sliding over inner surfaces of the inner body member beneath its threaded connection to the outer body member and generally opposite the locking means, as the wedge means moves in one vertical direction with respect to the body means, so as to wedge the locking means into the groove and the conically tapered surface thereon tightly against the conically tapered surfaces of the upper end of the groove, and a nut threadedly connected to the wedge ring and mounted on the body for rotation with respect thereto while being held against vertical movement in said opposite vertical direction, said nut having means thereon engagable by means on a tool lowered through the conductor for rotating the nut in order to move said wedge means in said one vertical direction.

6. A tieback connector of the character defined in claim 5, wherein said nut is held against vertical movement by a stop ring supported on the nut and above the wedge ring, and a split ring releasably retained in a groove within the outer body member to bear on the stop ring, and said means connecting the inner and outer body members comprises pins extending through the outer member and into the inner member.

7. A tieback connector of the character defined in claim 5, wherein the locking means is a split ring which is inherently contractable toward its inner position.

8. A tieback connector of the character defined in claim 5, wherein seat means of the wellhead member includes an outer surface and a outer surface within the seat and above the groove, and the shoulder means of the body means has an outer surface adapted to be supported on the outer surface and a lower extension within the outer surface and a complementary seal surface on the extension for disposal closely within the seal surface on the wellhead member, and seal means are carried by the seal surface of the body means extension to sealably engage the seal surface of the wellhead member.

9. A tieback connector of the character defined in claim 5, wherein the surfaces on the wedge fingers are on its lower end for moving downwardly into wedging position.

* * * * *